United States Patent [19]

Marchand

[11] Patent Number: 4,492,520

[45] Date of Patent: Jan. 8, 1985

[54] MULTI-STAGE VANE STATOR FOR RADIAL INFLOW TURBINE

[76] Inventor: William C. Marchand, 11339 Roxbury Avenue, Detroit, Mich. 48224

[21] Appl. No.: 376,327

[22] Filed: May 10, 1982

[51] Int. Cl.[3] ..... F01D 1/08

[52] U.S. Cl. ..... 415/150; 415/152 R

[58] Field of Search ..... 415/152 R, 152 A, 150, 415/151, 115, 157, 158

[56] References Cited

U.S. PATENT DOCUMENTS

| | | | |
|---|---|---|---|
| 2,421,445 | 6/1947 | Waller | 415/152 U X |
| 2,870,956 | 1/1959 | Dhonau et al. . | |
| 2,971,333 | 2/1961 | Mendelsohn et al. . | |
| 2,976,013 | 3/1961 | Hunter . | |
| 3,000,611 | 9/1961 | Liston . | |
| 3,007,675 | 11/1961 | Süss . | |
| 3,069,072 | 12/1962 | Birmann . | |
| 3,224,194 | 12/1965 | De Feo et al. . | |
| 3,232,581 | 2/1966 | Swearingen . | |
| 3,243,159 | 3/1966 | Hefler et al. . | |
| 3,489,339 | 1/1970 | Greenwald . | |
| 3,495,921 | 2/1970 | Swearingen . | |
| 3,799,694 | 3/1974 | Duzan . | |
| 3,816,021 | 6/1974 | Lewis et al. . | |
| 3,954,349 | 5/1976 | Abild . | |
| 3,966,352 | 6/1976 | White et al. . | |
| 3,972,644 | 8/1976 | Johnson . | |
| 3,990,809 | 11/1976 | Young et al. . | |
| 4,003,199 | 1/1977 | Bell et al. . | |
| 4,089,617 | 5/1978 | Koeller . | |
| 4,179,247 | 12/1979 | Osborn . | |
| 4,220,008 | 9/1980 | Wilber et al. | 415/150 X |

FOREIGN PATENT DOCUMENTS

| | | | |
|---|---|---|---|
| 986680 | 8/1951 | France | 415/158 |
| 1084552 | 1/1955 | France | 415/158 |
| 738987 | 10/1955 | United Kingdom | 415/152 |
| 753316 | 7/1956 | United Kingdom . | |
| 2031069 | 3/1980 | United Kingdom | 415/157 |

*Primary Examiner*—Robert E. Garrett
*Assistant Examiner*—Joseph M. Pitko
*Attorney, Agent, or Firm*—Remy J. VanOphem

[57] ABSTRACT

A turbine having a radial inlet to the turbine wheel is provided with a multi-stage stator wherein the vanes of its separate stages are fixed at different angles of incidence. The stator is mounted for movement so that each of its stages may be positioned in alignment with said opening. The vanes of one stage of the stator are inclined relative to the inlet to produce forward rotation of the turbine wheel while those of another stage are inclined oppositely to produce reverse rotation thereof. The system includes means for positioning the stator so that the vanes of two adjacent stages thereof are located in partial alignment with the inlet opening so as to regulate the power output of the turbine to a neutral state.

7 Claims, 16 Drawing Figures

MULTI-STAGE VANE STATOR FOR RADIAL INFLOW TURBINE

BACKGROUND OF THE INVENTION

1. Field of the Invention

The present invention relates to gas turbine engines for powering automotive and other vehicles and, more particularly, to a gas turbine engine having a multi-stage stator assembly for controlling the forward and reverse motion of the output shaft of the turbine, as well as to provide internal braking of the output shaft.

2. Description of the Prior Art

It is known in turbine engines to provide adjustability in the nozzle blades, which direct the flow of the gases to the blades of the turbine rotor, in a manner such that the incidence angle of the stator vanes relative to the turbine blades is most suitable for maximum efficiency at different speeds and loads. Such adjustability has been accomplished by rotating the blades about their central axes to effect the flow path therebetween. Such stator blades have been rotated by means of inner and outer gear rings, levers, or cam devices to accomplish different incidence angles relative to the turbine wheel. To function well, the stator vanes must come as close as possible to the outer ends of the turbine vanes, such as to favor laminar flow. A disadvantage of such devices is that their designs often fail to prevent leakage of gases between the end portions of the blades and their inner and outer mounting rings and, consequently, prevent precise and positive control of the turbine. In addition, such parts often are subjected to substantial vibration, flutter, wear, and seizure. Moreover, designs of this type are costly to fabricate and assemble, and have been very expensive to maintain.

The prior art is exemplified by the following U.S. Patents:

| U.S. PAT. NO. | ISSUED |
|---|---|
| 3,232,581 | February 1, 1966 |
| 3,243,159 | March 29, 1966 |
| 3,972,644 | August 3, 1976 |
| 4,003,199 | January 18, 1977 |

These prior art arrangements for varying the positions of vanes in a stator in a radial inflow turbine are usually only good for one position and have been found to be inadequate to properly and precisely control the flow of gases to the turbine wheel of the turbine for varying speed and loads.

SUMMARY OF THE INVENTION

It is a primary object of the present invention to provide a turbine of improved construction for driving a vehicle, which turbine avoids one or more of the shortcomings of the prior art.

It is another object of the present invention to provide improved components for controlling a turbine for driving a vehicle, which improved components eliminate the need for a fluid coupling or clutch for transferring power from the power turbine shaft to a vehicle transmission.

It is still another object of the present invention to provide a turbine engine of improved construction for driving a vehicle, which turbine engine has a shiftable multi-stage stator assembly for transferring power directly from the turbine shaft to a vehicle transmission as motive power for forward motion, reverse motion, and a neutral driving state, as the gasifier of the turbine engine is running at any speed.

It is still another object of the present invention to provide an improved, radial inflow turbine engine for driving a vehicle, which turbine engine has components of greatly simplified construction to produce vehicle braking by reversing the direction of gas flow to the turbine wheel of the turbine.

It is still another object of the present invention to provide an improved turbine for driving and braking a vehicle, which improved turbine has a shiftable variable inlet control assembly to regulate the amount of power absorption of the power turbine shaft.

In accordance with the primary aspect of the present invention, a free turbine for driving a vehicle includes a turbine housing having a turbine wheel rotatably mounted therein, and an inlet means for directing gas inwardly into the turbine wheel. The free turbine is further provided with a multi-stage stator assembly wherein each stage includes inlet vanes fixed at a predetermined angle of incidence. Mounting means are provided for the multi-stage stator assembly to enable movement thereof relative to the inlet, and control means are operatively connected to the multi-stage stator assembly to position any one of the stages thereof over the inlet means.

DETAILED DESCRIPTION OF THE PREFERRED EMBODIMENT

Figure 1:
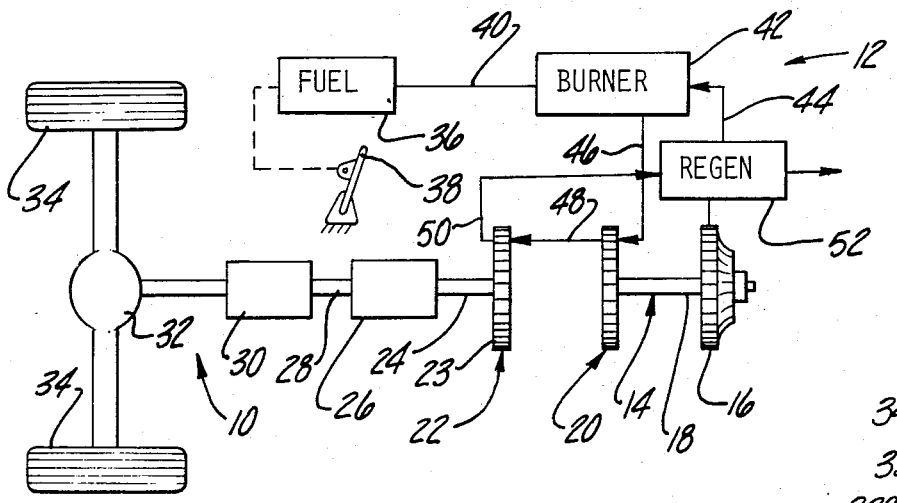
FIG. 1 is a schematic view of a vehicle having a turbine engine assembly embodying the present invention.

Referring to FIG. 1, a motor vehicle 10, illustrated in diagrammatic form, has a turbine engine assembly 12, which may be of the two-shaft type, including a free turbine or power turbine 22 and a spool 14 having a compressor 16 connected by a shaft 18 to a gasifier turbine 20. The power turbine 22 embodying the present invention includes a turbine impeller wheel 23 fixed on a free-wheeling output shaft 24 which is connected through a gear reduction unit 26 to a drive shaft 28. The drive shaft 28 is coupled to a transmission 30 to transfer drive power thereto, drive power is thence transferred from the transmission 30 through a differential and rear axle assembly 32 to the drive wheels 34 of the motor vehicle 10.

A fuel control 36 for the motor vehicle 10 is connected to an accelerator pedal 38 to supply fuel at a suitable rate through a conduit 40 to a burner 42 of the turbine engine assembly 12. The burner 42 is supplied with a source of air through a conduit 44 connected to the outlet of the compressor 16. Combustion products, including hot gases, from the burner 42 are directed through outlet lines 46 and 48 for driving the power turbine 22 and the gasifier turbine 20. The exhaust from the power turbine 22 and the gasifier turbine 20 may be directed through a conduit 50 to a regenerator 52 for preheating air from the compressor 16 prior to its passage along the conduit 44 into the burner 42.

Figure 2:
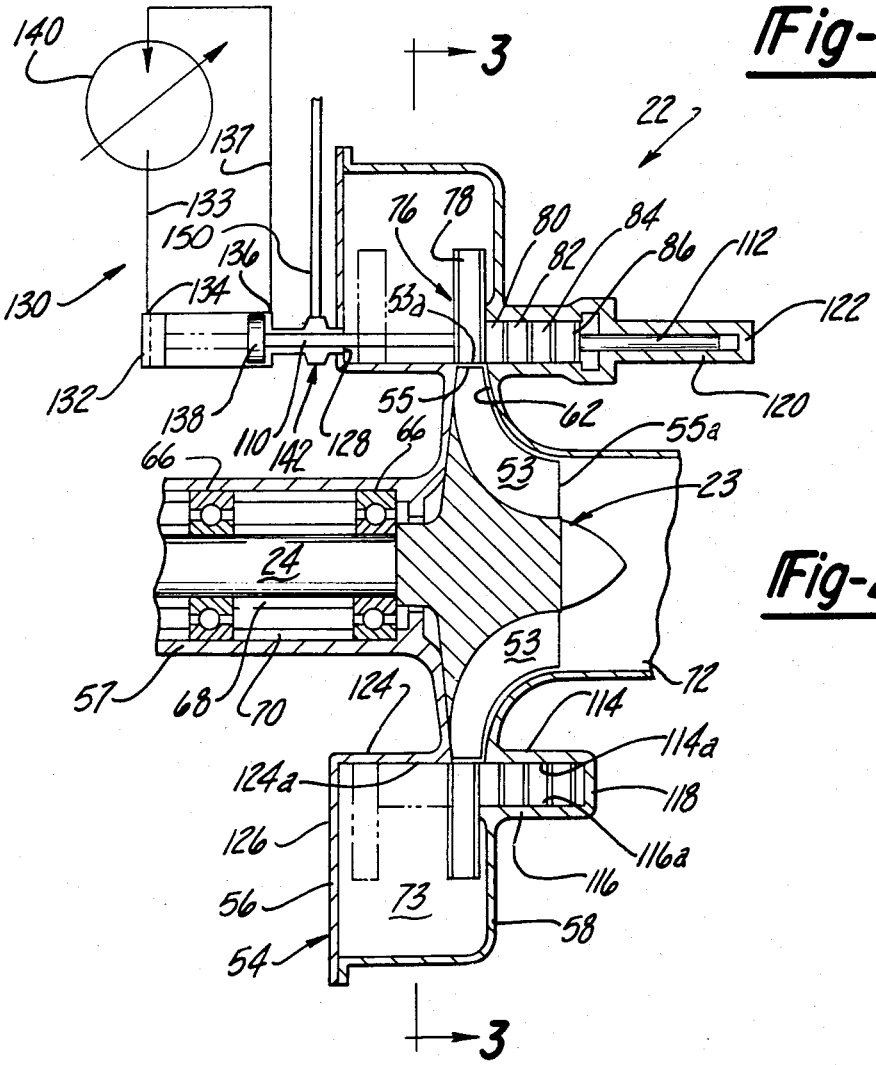
FIG. 2 is a fragmentary cross-sectional view of a turbine having a shiftable multi-stage stator assembly illustrating a preferred embodiment of the present invention.
Figure 3:
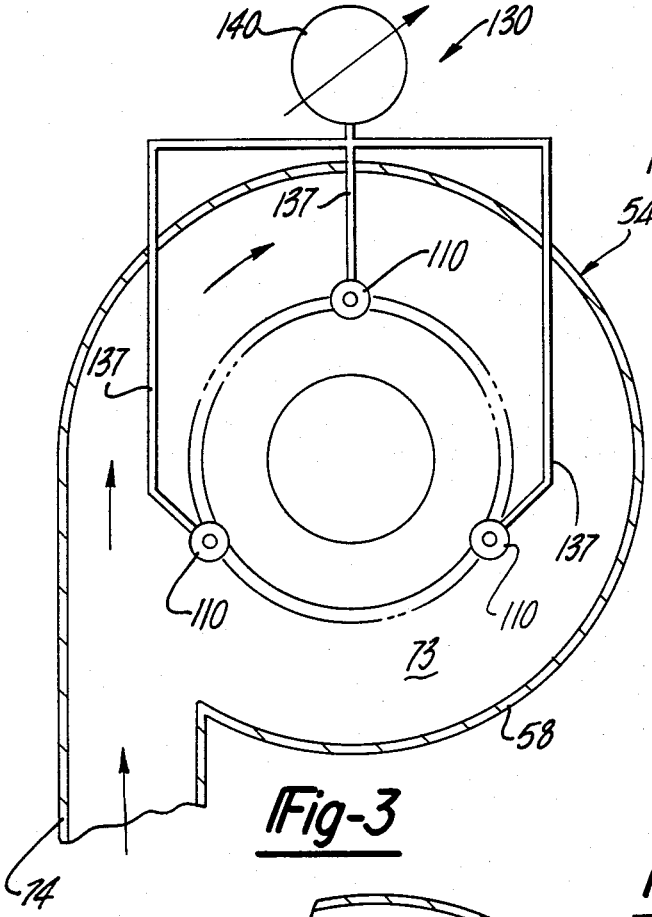
FIG. 3 is an end view, with parts cutaway, of the housing of the turbine of FIG. 2 with hot gases coming from the gasifier section of the turbine.

In accordance with the teachings of the present invention, a preferred embodiment of the power turbine 22, as best shown in FIGS. 2 and 3, includes the turbine impeller wheel 23 having suitable axial flow vanes 53 mounted for free rotation within an annular housing 54. The annular housing 54 includes housing portions 56 and 58 which are complementary and mating so as to cooperate to define an inlet duct 74 for entry of hot gases and combustion products from the burner 42 into the annular housing 54. In addition, the housing portions 56 and 58 define a circumferential inlet 62 for the gases to the axial flow vanes 53 of the turbine impeller wheel 23. Each axial flow vane 53 has a radial inlet end 55 adjacent the circumferential inlet 62 and an axial outlet end 55*a*. The housing portion 56 of the annular housing 54 includes an axial sleeve portion 57 which mounts to the free wheeling output shaft 24 of the turbine impeller wheel 23 for free rotation relative thereto by means of suitable bearing elements 66 maintained in spaced apart relationship by spacer sleeves 68 and 70. The housing portion 58 of the annular housing 54 is likewise configured to define an inner passage 72 for conveying combustion products from the blades to the regenerator 52 for preheating compressed air from the compressor 16 prior to entering the burner 42. The gases are directed by means of an inlet duct 74 around an annulus 73 of the annular housing 54. The direction of the flow of gases, through the circumferential inlet 62 is controlled by means of a stator assembly 76 hereinafter to be described.

Figure 7:
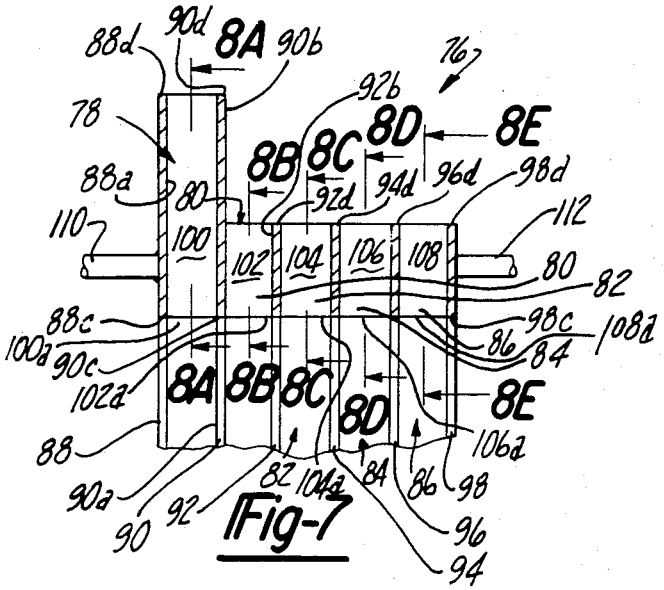
FIG. 7 is a partial cross-sectional view through the multi-stage stator of the turbine of FIG. 2 illustrating supporting shaft means therefor.
Figure 8A:
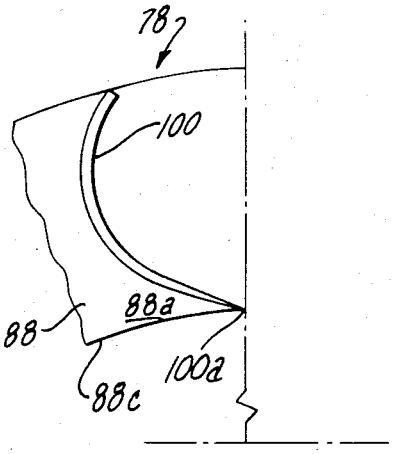
FIGS. 8A through 8E, inclusive, are sectional views through various stages of the multi-stage stator illustrating the various pitch angles of the vanes of the various stages of the multi-stage stator.
Figure 8B:
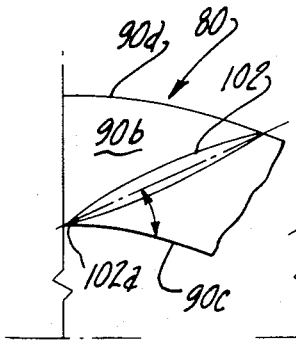
Figure 8C:
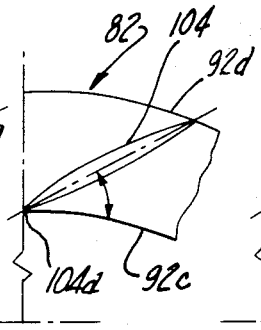
Figure 8D:
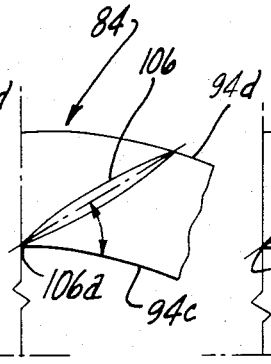
Figure 8E:
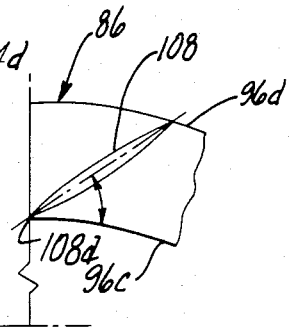

Referring now to FIGS. 4 through 7 and 8A through 8E, the stator assembly 76 consists of several stages which, in the drawing, includes a reverse stage 78 and four forward stages: a first forward stage 80, a second forward stage 82, a third forward stage 84 and a fourth forward stage 86, respectively. The different reverse and forward stages 78, 80, 82, 84, and 86 are united into a unitary construction consisting of a plurality of flat, axially spaced ring members 88, 90, 92, 94, 96 and 98, which mount a reverse set of vanes 100 and four forward sets of vanes 102, 104, 106 and 108. The vanes 100, 102, 104, 106 and 108 may be suitably secured between adjacent side wall surfaces of the ring members by braising or other suitable means. The angles of incidence of the vanes of each set of vanes, as illustrated, are different, one from another. By way of specific example, the reverse set of vanes 100 constituting the reverse stage 78 are shown in FIG. 7 as being mounted between the axially spaced ring members 88 and 90 and secured in bridging relationship to the corresponding side wall surfaces 88*a* and 90*a*, respectively. The next adjacent stage, the first forward stage 80, is contiguous with and abuts the reverse stage 78. The first forward stage 80 consists of the forward set of vanes 102, best shown in FIG. 8B, of a different shape and configuration from the reverse set of vanes 100, and are likewise fixedly supported at their opposite edges between the opposed side wall surfaces 90*b* and 92*b* of the axially spaced ring members 90 and 92, respectively. In a similar manner, the next adjacent forward sets of vanes 104, 106 and 108, constituting the second, third, and fourth stages 82, 84, and 86, respectively, are contiguously and sequentially secured in abutting relationship to the axially spaced ring members 92 and 94, 94 and 96, and 96 and 98, respectively, to form a rigid unitary multi-stage unit for the stator assembly 76.

With reference now to FIG. 2, it is observed that the turbine blades 53 at their radial inlet ends 55 have an outside diameter such that a minimum clearance is provided to enable relative rotation thereof with respect to the trailing or inner edges of the vanes 100, 102, 104, 106 and 108. This extremely close juxtaposition of the inner edges of the vanes relative to the outer diametrical marginal edges of the axial flow blades 53 precludes creation of turbulent flow and maintains instead a desirable laminar flow for the hot gases, thereby significantly enhancing the efficiency of the turbine.

In order to selectively position the individual stages 78, 80, 82, 84 and 86 of the stator assembly 76 opposite the circumferential inlet 62 defined by the housing portions 56 and 58 for the turbine impeller wheel 23, suitable stator mounting means 109 are provided. For this purpose, a plurality of rod elements 110 and 112 are suitably fixedly secured to the ring members 88 and 98, respectively, in coincident aligned relationship to one another, and parallel to the axis of rotation of the turbine impeller wheel 23. As seen in FIG. 2, the stator assembly 76 may be selectively shifted between the first position shown in full line and the second position shown in phantom line, as well as individual intermediate positions therebetween. It is observed that the housing portion 58 includes inner and outer axially extending flange portions 114 and 116 which have surfaces 114*a* and 116*a* which engage the inner and outer peripheral edge portions 92*c*, 92*d*, 94*c*, 94*d*, 96*c*, 96*d*, 98*c* and 98*d* of the ring members 92, 94, 96 and 98, which demarcate the forward stages of the stator assembly 76 in the first position as more clearly shown in FIG. 7. It is further seen that the plurality of rod elements 110 and 112, provided for the assembly, are disposed equally spaced circumferentially around the axis of rotation of the power turbine 22. An end wall 118 serves to close the opening between the inner and outer axially extending flange portions 114 and 116. The end wall 118 integrally includes therewith a plurality of axially disposed sockets 120 closed at their ends 122. The axially disposed sockets 120 receive therein for guiding movement outer end portions of the plurality of rod elements 112. The axially disposed sockets 120, however, restrain rotational movement of the stator assembly 76 about the axis of rotation of the turbine impeller wheel 23. The housing portion 56 likewise includes an axial flange portion 124 of like diameter and aligned with the inner axially extending flange portion 114 of the housing portion 58. A surface **124*a* of the flange portion 124 and the surface 114*a* of the inner axially extending flange portion 114 provide bearing surfaces for the inner peripheral edge portions 88*c* through 98*c*, inclusive, of the axially spaced ring members 88 through 98, respectively, as more clearly shown in FIG. 7. In addition, a surface 116*a* of the outer axially extending flange portion 116 constitutes an outer retaining surface for the outer edge portions of the axially spaced ring members 88 through 98** inclusive.

Still referring to FIG. 2, it is seen that the housing portion 56 includes a vertical wall portion 126 which includes apertures 128 adjacent the axial flange portion 124, to support end portions of the rod element 110 in sliding bearing engagement.

In order to control the movement of the stator assembly 76 relative to the circumferential inlet 62 of the turbine impeller wheel 23, a control assembly 130 is provided which, in the present instance, may include a suitable source of fluid energy and means to convert the fluid energy to mechanical force and motion. In lieu of the fluid means shown, other sources of power, such as electrical or mechanical power may be used to position the stator assembly 76. The control assembly 130 illustrated includes a linear actuator in the form of a double-acting cylinder 132 having ports 134 and 136, accommodating fluid lines 133 and 137, respectively, in its cap end 135 and its rod end 139 (shown in FIG. 7). A piston 138 of the linear actuator is affixed to the rod element 110 of the stator assembly 76. A variable displacement motor 140 is shown connected to the double-acting cylinder 132 to suitably extend or retract the piston 138 and the rod element 110 connected thereto so as to selectively move the stator assembly 76 parallel to the axis of rotation of the turbine impeller wheel 23 so that a preselected stage of the stator assembly 76 is positioned opposite the inlet 62 of the turbine impeller wheel.

Figure 9:
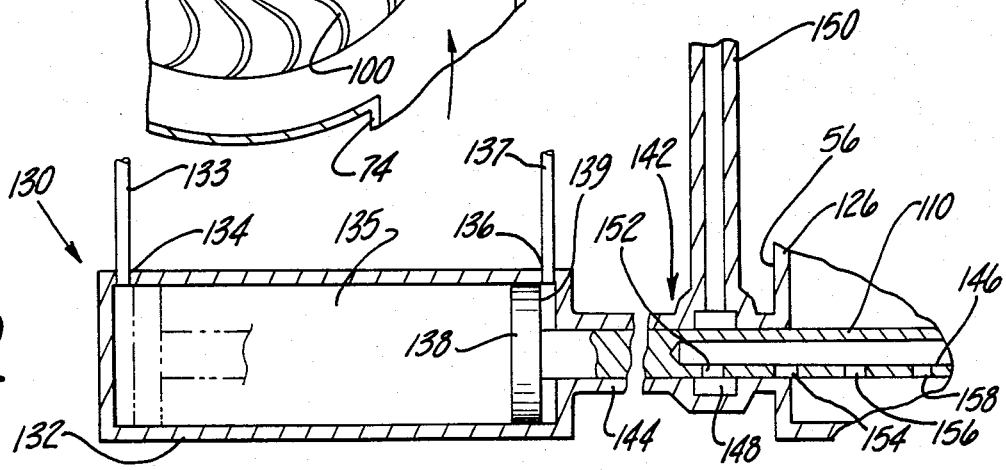
FIG. 9 is a partial view of the turbine illustrated in FIG. 2, showing a cool air pressure unit to keep hot gases from heating up the control unit.

In order to shield the linear actuator of the control assembly 130 from undue heat from the power turbine 22, a heat shield 142 is shown interposed between the housing portion 56 and the linear actuator means, as shown in FIG. 9. A sleeve 144 is shown encircling the rod element 110 and extending between the end of double-acting cylinder 132 and the vertical wall portion 126 of the housing portion 56. Integral with the sleeve 144, there is provided an annular passage 148. A hollow tube 150 is suitably connected to the annular passage 148 to introduce a suitable amount of cool air from the compressor 16 illustrated diagrammatically in FIG. 1.

The air so received is forced from the annular passage 148 and bled into an axial bore 146 in the rod element 110 via a plurality of radial openings 152, 154, 156 and 158 in the rod element and further directed into the annular housing 54 of the stator assembly 76. Since the air from the compressor 16 is colder and of a greater mass than the hot combustion products in the power turbine 22, the heat from the latter is thus prevented from reaching the control assembly 130 to avoid rendering it inoperative due to excessive heat.

Figure 4:
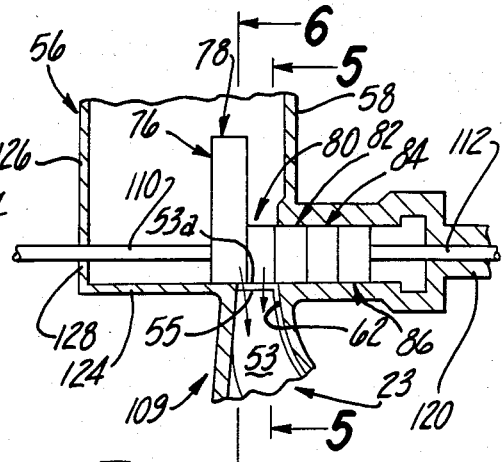
FIG. 4 is a fragmentary view similar to a portion of FIG. 2, greatly enlarged, showing vanes of two stages of the multi-stage stator, a forward stage and a reverse stage, each disposed over and partially in line with the opening of the turbine.
Figure 5:
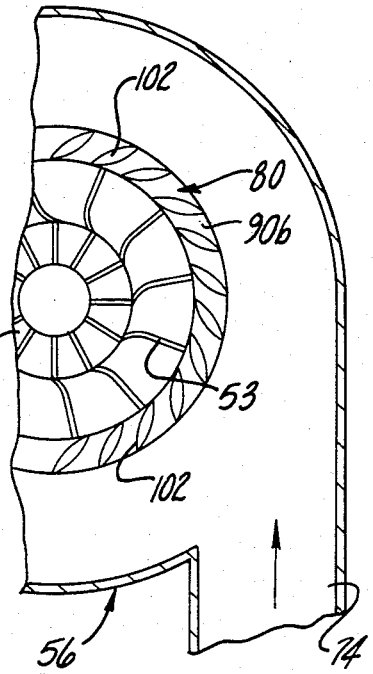
FIG. 5 is a sectional view taken along lines 5—5 of FIG. 4 through the turbine of FIG. 2 with the vanes of a forward stage of the multi-stage stator aligned with the inlet of the turbine for inducing forward rotation of the turbine wheel.
Figure 6:
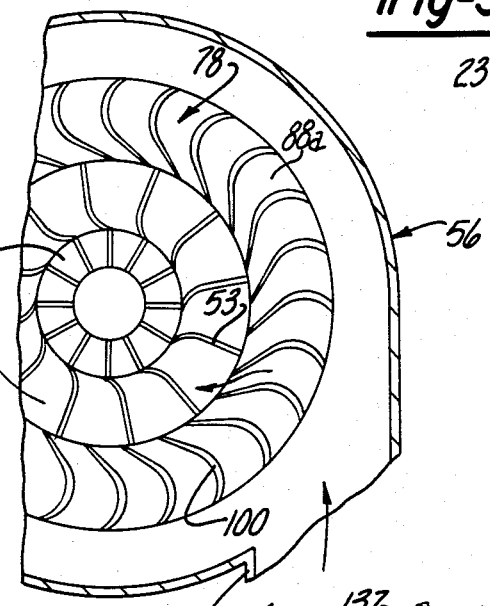
FIG. 6 is a sectional view taken along lines 6—6 of FIG. 4 through the turbine of FIG. 2 with the vanes of a reverse stage of the multi-stage stator aligned with the inlet of the turbine for inducing reverse rotation of the turbine wheel.

Referring now to FIG. 4, it is observed that the stator assembly 76 has been shifted a slight distance axially to the left as compared to the most rightward position of the stator assembly illustrated in FIG. 2. In the position of the stator assembly 76 shown in FIG. 4, the reverse stage 78 and the first forward stage 80 of the stator assembly are each partially in alignment with the inlet 62 defined by the housing portion 56 for the turbine impeller wheel 23. In this position of the stator assembly 76 and with the gasifier turbine 20 of the turbine engine assembly 12 running at any speed, the force and direction of the hot gases passing through the reverse set of vanes 100 of the reverse stage 78 are nullified by the force and direction of the gases passing the vanes 102 of the first forward stage 80 of the stator assembly 76. As a consequence, the energy absorbed by the turbine impeller wheel 23 is rendered into a relatively neutral state regarding the torque and the direction of rotational output. This action can be understood by referring to FIGS. 5 and 6. First, with reference to FIG. 5, it is seen that the gases passing through the vanes 102 of the first forward stage 80 strike the axial flow vanes 53 of the turbine impeller wheel 23 in a direction to cause counterclockwise rotation of the turbine impeller wheel. Whereas, with reference to FIG. 6, it is seen that the hot gases are controlled in a direction by means of the vanes 100 of the reverse stage 78 of the stator assembly 76 to cause a clockwise rotation of the turbine impeller wheel 23. Upon summing the force components illustrated in FIGS. 5 and 6, it can be appreciated that a zero torque output of the turbine impeller wheel may be obtained upon the stator being so positioned axially, as illustrated in FIG. 4.

In considering the operation of the power turbine 22 just described, it will be seen that it differs from conventional variable vane stators in that it employs a stator construction in which the various stages of differently pitched vanes are securely fastened to the spaced apart ring members 88 through 98, making up the stator assembly 76, whereas in prior constructions the vanes are provided with means for pivoting the vanes relative to their mounting structure. The power turbine 22 employs the principle of mechanically moving the stator assembly 76 parallel to the axis of rotation of the turbine impeller wheel 23 to present vanes having a predetermined fixed pitch angle opposite the inlet end of the turbine impeller wheel.

In operation, hot gases and combustion products from the burner 42 are directed through the outlet line 46 to the gasifier turbine 20 and, thence, through the outlet line 48 into the inlet duct 74 of the annular housing 54 of power turbine 22. The operator of the motor vehicle 10, upon desiring a given forward mode of propulsion, actuates the variable displacement motor 140 through an appropriate degree of movement. This causes the piston 138 of the control assembly 130 to slide in its double-acting cylinder 132 and, thereby, to actuate the rod element 110 affixed to the stator assembly 76. The stator assembly 76 is thereby positioned so that the vanes corresponding to a preselected stage of the rotor are positioned in radial alignment with the radial inlet end 55 of the axial flow vanes 53 of the turbine impeller wheel 23 and across the inlet 62 for exhausting the gases from the annular housing 54. Assuming that the operator desired the first forward speed stage 80, the stator assembly 76 would thus have been shifted so that the forward set of vanes 102 would be in alignment with the inlet 62, seen in FIG. 5, and the turbine impeller wheel 23 would absorb rotational energy corresponding to a first forward speed. If, on the other hand, other forward modes of movement were desired, the operator would actuate the variable displacement motor 140 an appropriate amount and direction to cause one of the remaining sets of the vanes 104, 106 or 108 to be positioned in a like manner across the inlet 62 to suitably energize the turbine impeller wheel 23.

Alternatively, if the operator desired to cause a braking action to be imparted to the vehicle, he would actuate the aforementioned variable displacement motor 140 to cause downshifting from a higher to a lower forward stage of the stator assembly. Alternatively, further braking action is obtained when both the first forward stage 80 and the reverse stage 78 are simultaneously positioned across the inlet 62, in the manner as shown in FIG. 4. Since the first forward stage 80 normally tends to cause rotation of the turbine impeller wheel 23 in a forward direction, while the reverse stage 78 tends to rotate it in a reverse direction, it is seen that the sum of energies absorbed from each of the stages is cancelled one by the other and, hence, rotation of the free wheeling output shaft 24 of the turbine impeller wheel is inhibited. Moreover, since the end of the free wheeling output shaft 24 is directly coupled to the transmission 30 of the vehicle through the gear reduction unit 26, such braking action is imparted directly through the drive train to the drive wheels of the motor vehicle 10.

Figure 12:
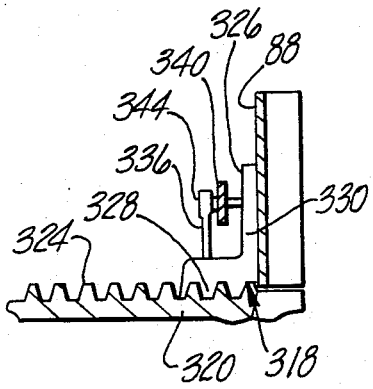
FIG. 12 is an elevational sectional view similar to a portion of FIG. 10, enlarged, showing mounting means for axially moving the stator.
Figure 11:
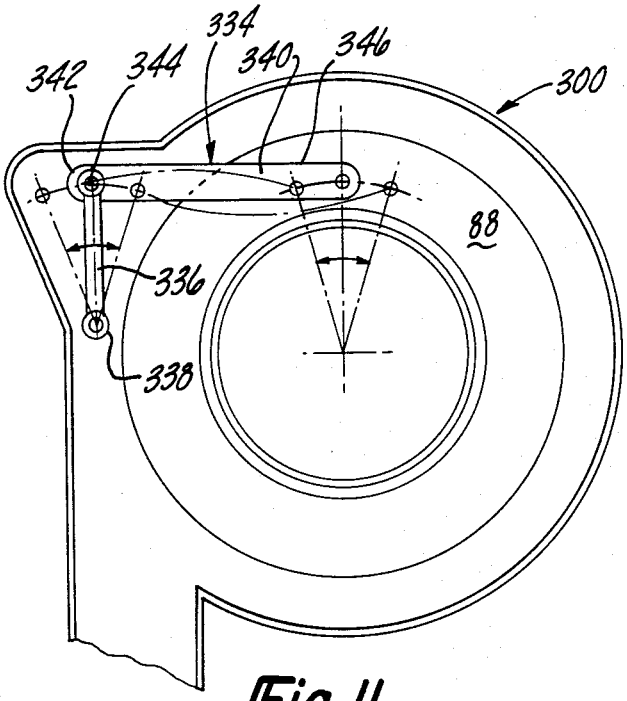
FIG. 11 is a partially schematic end elevational view of the turbine shown in FIG. 10, illustrating a mechanism associated with the multi-stage stator for axially advancing and retracting the multi-stage stator.
Figure 10:
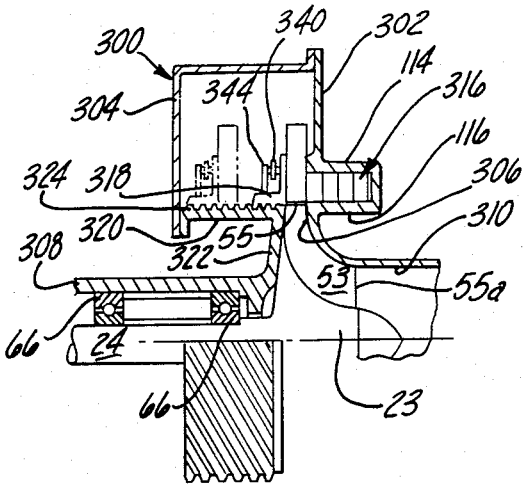
FIG. 10 is an elevational sectional view through a turbine, illustrating an alternate embodiment of the present invention.

A modification of the turbine engine of FIG. 2 embodying the present invention is shown in FIGS. 10 through 12. As in the prior embodiment, the turbine impeller wheel 23 is mounted for free rotation within the annular housing 300. The annular housing 300 includes complementary mating outer and inner housing portions 302 and 304 which, together, define an annulus 303 and an inlet duct 305 for the entry of hot gases from the burner 42 and the gasifier turbine 20 into the annular housing 300. The annular housing 300 in addition, defines an annular inlet 306 for the gases to impinge on the axial flow vanes 53 of the turbine impeller wheel 23. Each axial flow vane 53 has a radial inlet end 55 adjacent the annular inlet 306 and an axial outlet end 55*a*. The inner housing portion 304 includes a sleeve portion 308 which supports the free wheeling output shaft 24 of the turbine impeller wheel 23 for free rotation by means of the bearing elements 66. The outer housing portion 302 of the annular housing 300 is configured to define an axial passage 310 for conveying combustion products from the axial flow vanes 53 to the regenerator 52. The incoming hot gases from the gasifier section of the turbine engine assembly 12 are directed by means of the inlet duct 305, around the annulus 303 formed by the annular housing 300 and controlled in direction through the annular inlet 306 by means of a stator assembly 316. The various stages of the stator assembly 316 may be identical in configuration and construction as the stator assembly 76, illustrated in FIGS. 7 and 8A through 8E. In the present embodiment of the invention, novel and improved mounting means 318 are provided to enable the stator assembly 316 to be shifted fore and aft axially relative to the axis of rotation of the turbine impeller wheel 23 and so that the reverse and forward stages 78, 80, 82, 84, and 86 of the stator assembly 76 may be successively presented in alignment with the annular inlet 306 at the tips of the axial flow vanes 53 of the power turbine 22. For this purpose, the inner housing portion 304 includes a drum-like portion 320 shown encircling the sleeve portion 308 and interconnected therewith by means of a vertically inclined wall portion 322. The outer peripheral surface of the drum-like portion 320 defines helical threads 324 which engage complimentary helical threads 328 of an internally threaded sleeve member 326. The internally threaded sleeve member 326 includes an upstanding flange 330 which is suitably fixed to the ring member 88 of the stator assembly 316 to preclude relative movement therebetween. The pitch of the complimentary helical threads 324 and 328 are such that, upon applying a suitable tangential force to the upstanding flange 330 of the internally threaded sleeve member 326, the stator assembly 316 may be simultaneously rotated about the axis of rotation of the free wheeling output shaft 24 as well as being movable axially fore and aft along the axis of rotation to position various individual stages opposite the outer tips of the axial flow vanes 53 of the turbine impeller wheel 23.

In order to suitably control the stator assembly 316 for such rotational and axial movement, suitable control means 334 are suitably interconnected between the stator assembly 316 and the annular housing 300. Referring to FIG. 11, a crank arm 336 is fulcrumed for movement, as shown at 338, to the annular housing 300 and is connected at its upper end to one end 342 of a horizontally disposed link 340 by means of a suitable ball joint connection 344. The opposite end 346 of the horizontally disposed link 340 is similarly affixed to the upstanding flange 330 of the internally threaded sleeve 326 attached to the stator assembly 316 by means of a similar ball joint connection. It can thus be seen that, upon applying a suitable force to turn the crank arm 336, the various individual reverse and forward stages 78, 80, 82, 84 and 86 may be positioned in operative stages to suitably control and to produce high specific work on the mass air flow through the stator assembly 316 and the turbine impeller wheel 23.

While the above detailed description is of the preferred embodiments of the present invention, it will be apparent to those skilled in the art that various changes and modifications may be made therefrom without departing from the spirit of the present invention. It is, therefore, intended that the appended claims will cover all such changes and modifications as fall within the true spirit and scope of the present invention.

What is claimed as novel is as follows:

1. In a turbine engine for driving a vehicle, said turbine engine consisting of a turbine housing having a free turbine wheel rotatably mounted therein, and inlet means for directing a gas radially inwardly towards said free turbine wheel, the improvement comprising:

multi-stage stator vane means, said multi-stage stator vane means having a plurality of stator stages, each respective stator stage of said plurality of stator stages having respective inlet vanes set at a predetermined respective angle of incidence;

mounting means mounting said multi-stage stator vane means to said inlet means for relative movement therebetween;

control means operatively connected to said stator means to selectively locate any of said plurality of stator stages over said inlet means, said control means further comprising shaft means movably interconnected with said turbine housing and power actuated piston cylinder means fixedly interconnected with said shaft means to position said plurality of stator stages relative to said inlet means; and additional housing means provided between said power actuated piston cylinder means and said turbine housing, said additional housing means defining an annulus for the passage of fluid at a higher pressure than said gases in said turbine housing, to thereby provide a heat shield for said power actuated piston cylinder means.

2. The improvement of claim 1 wherein said plurality of stator stages comprises a plurality of forward stages, each respective forward stage of said plurality of forward stages having respective vanes set at a respective preselected optimum angle of incidence such as to cause forward motion of said free turbine wheel when each respective forward stage is positioned over said inlet means.

3. The improvement of claim 2 wherein said respective vanes of each said plurality of forward stages are set at said respective preselected optimum angle of incidence such that said respective preselected optimum angles of incidence differ progressively, one from another, such as to obtain a different forward thrust on said free turbine wheel when each of said respective forward stages are positioned over said inlet means.

4. The improvement of claim 2 wherein said plurality of stator stages further comprise a reverse stage having reverse vanes set at a reverse preselected angle of incidence such as to cause reverse rotation of said free turbine wheel when said reverse stage is positioned over said inlet means.

5. The improvement of claim 4 wherein said reverse stage is disposed adjacent a preselected forward stage of said plurality of forward stages such that a simultaneous partial positioning of said reverse stage and said preselected forward stage over said inlet means causes said free turbine wheel to experience zero net force, whereby, said free turbine wheel is in a neutral non-driving condition.

6. The improvement of claim 1 wherein said multi-stage stator vane means further comprises a plurality of flat ring members concentric with and spaced along the axis of rotation of said free turbine wheel, each adjacent pair of flat ring members of said plurality of flat ring members fixedly securing a plurality of vanes therebetween at a preselected angle of incidence.

7. The improvement of claim 6 wherein said mounting means comprises shaft means secured to one of said plurality of flat ring members, said shaft means being disposed parallel to said axis of rotation of said free turbine wheel, said turbine housing further comprising bearing sleeve means engaging said shaft means, such as to enable movement of said multi-stage stator vane means along said axis of rotation and such as to inhibit said multi-stage stator vane means from rotation relative to said turbine housing.

* * * * *